United States Patent [19]

Blair

[11] Patent Number: 4,733,543

[45] Date of Patent: Mar. 29, 1988

[54] PACKAGED AIR CONDITIONER

[75] Inventor: Robert R. Blair, Dallas, Tex.

[73] Assignee: Enviromaster International Corporation, Rome, N.Y.

[21] Appl. No.: 938,595

[22] Filed: Dec. 5, 1986

[51] Int. Cl.[4] ..... F25D 23/12

[52] U.S. Cl. ..... 62/263; 62/298; 312/236

[58] Field of Search ..... 62/298, 262, 263, 259.1; 312/236, 245, 242, 293, 257 R, 257 A, 263; 98/114, 94.2

[56] References Cited

U.S. PATENT DOCUMENTS

| | | | |
|---|---|---|---|
| 3,301,003 | 1/1967 | Laing | 62/263 X |
| 3,438,219 | 4/1969 | Brugler | 62/263 X |
| 3,766,749 | 10/1973 | Livesay | 62/298 X |
| 4,100,764 | 7/1978 | Murano | 62/298 X |
| 4,416,327 | 11/1983 | Nakada et al. | 62/262 X |
| 4,637,223 | 1/1987 | Hosoya et al. | 62/263 |

FOREIGN PATENT DOCUMENTS

| | | | |
|---|---|---|---|
| 0152835 | 8/1985 | Japan | 62/263 |

*Primary Examiner*—Harry B. Tanner

*Attorney, Agent, or Firm*—Bruns and Wall

[57] ABSTRACT

A package terminal air conditioning unit that is split into two sections, an indoor section and an outdoor section. The components of the indoor section are housed in an indoor cabinet of all molded construction having a recirculating air duct that is contoured to conduct air quietly and efficiently through the cabinet. Interchangeable guide vanes are also mounted in the air duct to act in conjunction with a crossflow fan rotor which permits the cabinet to be adapted to accommodate fans of different sizes and shapes without having to alter the configuration of the molded cabinet. The outdoor section simply contains a heat exchanger and a small blower which are housed in a lightweight cabinet. The outdoor cabinet used in one preferred embodiment of the invention is hung on the outside wall of a building and the outdoor heat exchanger is connected to the remaining air conditioning components housed in the indoor cabinet by two refrigerant lines.

11 Claims, 8 Drawing Figures

PACKAGED AIR CONDITIONER

BACKGROUND OF THE INVENTION

This invention relates to a package terminal air conditioning unit and, in particular to a split package terminal in which some of the air conditioning components are housed in an indoor cabinet of all molded construction and are connected to the remaining components housed in an outdoor cabinet by a pair of refrigerant exchange lines.

As described in U.S. Pat. No. 4,480,533 many package terminal units consist of a single self-standing cabinet that houses all of the component parts of an air conditioning system needed to heat or cool a specific zone or region within a building. The cabinet is typically situated next to an outdoor wall of the building and a rather large and unsightly air duct is passed through the wall so that sufficient outdoor air can be exchanged with the indoor air to satisfy the requirements of the unit. These ducts can structurally weaken the building, create unwanted loss of energy from the building and considerably alter the appearance of the building.

Most of today's package terminal units are housed in rather bulky metal cabinets in which heavy metal cover panels are mounted upon an equally heavy framework of metal support members. The heavy panels must be removed in order to gain access to the air conditioning components housed in the cabinet so that repairing and maintaining the unit can be a difficult and time consuming task. The metal panels can be easily dented or scratched through normal use. The metal parts of the cabinet are also exposed continually to moisture and refrigerants from the air conditioning unit which promotes rapid oxidation and rusting of these metal parts. As the rusting process progresses the parts or even the entire cabinet must be replaced which, of course, can be expensive.

The indoor air within the conditioned zone is drawn into the cabinet and passed over a heat exchanger before being discharged back into the zone. The duct work leading to and from the heat exchanger is usually formed of sheet metal. For the most part little or no consideration is given to the aerodynamics of the air moving pump or fan when designing the duct work. Consequently, the air handling characteristics of most metal cabinets are relatively poor and little can be done to improve the efficiency of the air flow through the system. Cabinets that have been specifically designed for use with a particular air conditioning unit must oftentimes be abandoned or considerably reworked when the unit is changed because the cabinet lacks flexibility to accommodate even minor changes in design.

SUMMARY OF THE INVENTION

It is therefore an object of the present invention to improve package terminal air conditioning units.

It is a further object of the present invention to provide a molded indoor cabinet for a package terminal air conditioning unit that has greatly enhanced air handling characteristics.

It is a still further object of the present invention to provide a package terminal air conditioning unit that contains a molded indoor cabinet, having enhanced air handling characteristics, that is connected to an outdoor cabinet by a pair of refrigeration lines.

Another object of the present invention is to provide a split package terminal air conditioning unit that does not require relatively large connecting ducts to be passed through a separating wall of a building.

Still another object of the present invention is to provide a high efficiency air conditioning unit that has an outdoor heat exchanger cabinet that can be hung upon the outer wall of a building or alternatively mounted within the wall of a building.

Yet another object of the present invention is to provide a package terminal unit that has an indoor cabinet of molded construction that can be adapted to accommodate air conditioning units of different configurations without having to redesign the cabinet.

These and other objects of the present invention are attained by a package terminal air conditioning unit having an indoor cabinet and an outdoor cabinet. The indoor cabinet is molded in three main sections that include a base section, a back section, and a removable front cover section which combine in assembly to form an equipment compartment and an air duct for circulating indoor air through the cabinet. The circulating air duct contains an indoor heat exchanger and a crossflow fan rotor for circulating air over the heat exchanger. The equipment compartment houses the unit compressor, an expansion valve, and other related components. The circulating air duct is contoured to conduct air therethrough in a stabilized laminar flow. A guide vane is also mounted in the air duct that acts in association with a particular configuration to provide for efficient movement of air through the fan rotor. By simply changing the guide vane, the cabinet can be adapted to accommodate fans of various sizes and shapes without having to change the basic configuration of the cabinet.

The outdoor cabinet houses a second heat exchanger and a blower for moving ambient air over the exchanger surfaces. The second heat exchanger is connected to air conditioning components housed in the indoor cabinet by two refrigerant lines.

BRIEF DESCRIPTION OF THE DRAWINGS

For a better understanding of these and other objects of the present invention reference is had to the following detailed description of the invention which is to be read in conjunction with the accompanying drawings, wherein.

DETAILED DESCRIPTION OF THE INVENTION

Figure 1:
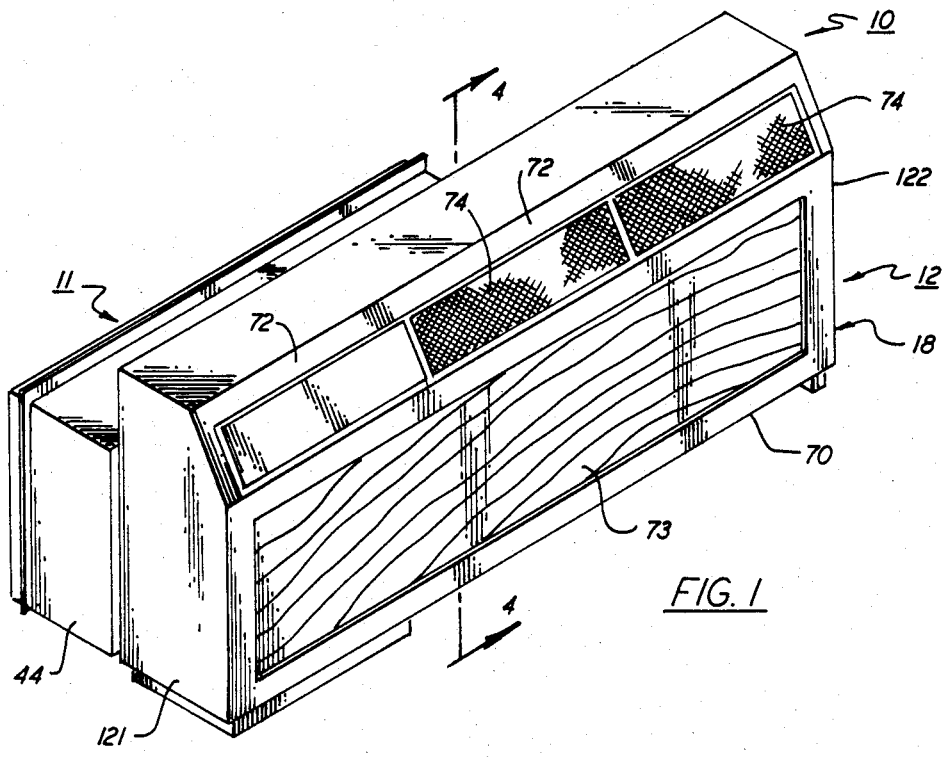
FIG. 1 is a perspective view of a split package terminal air conditioning unit that includes an indoor cabinet and an outdoor cabinet embodying the teaching of the present invention.
Figure 3:
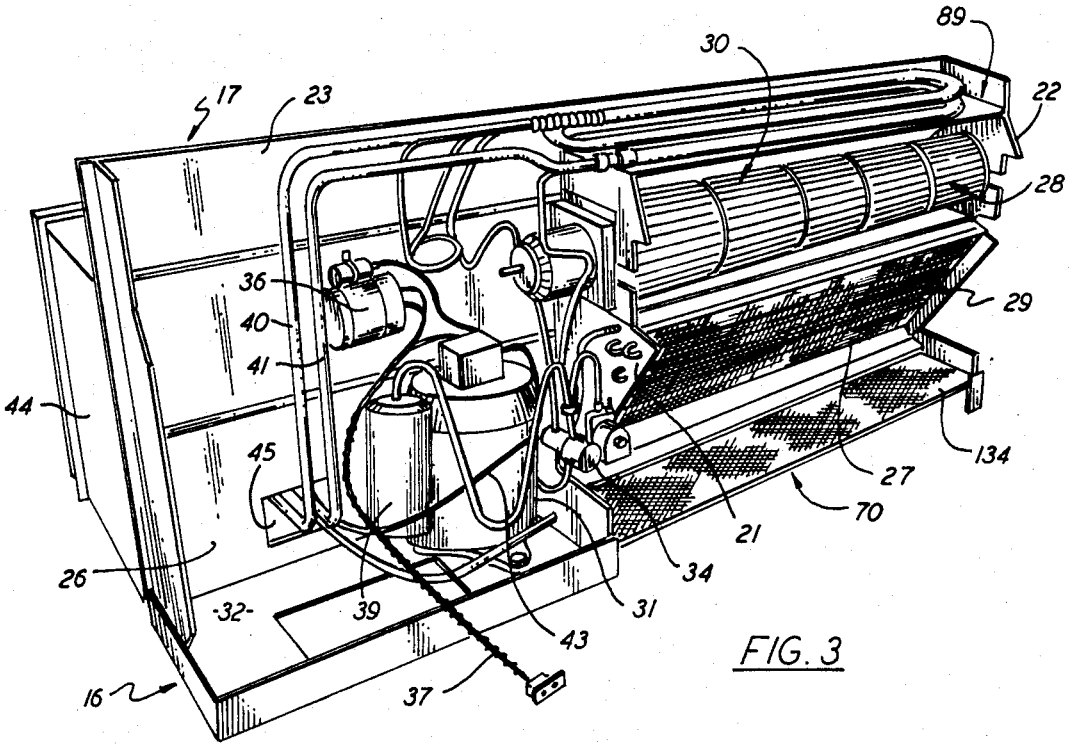
FIG. 3 is a perspective view of the package terminal air conditioner unit shown in FIG. 1 with the cover section of the indoor cabinet being removed to show the component parts of the air conditioning system housed therein.
Figure 2:
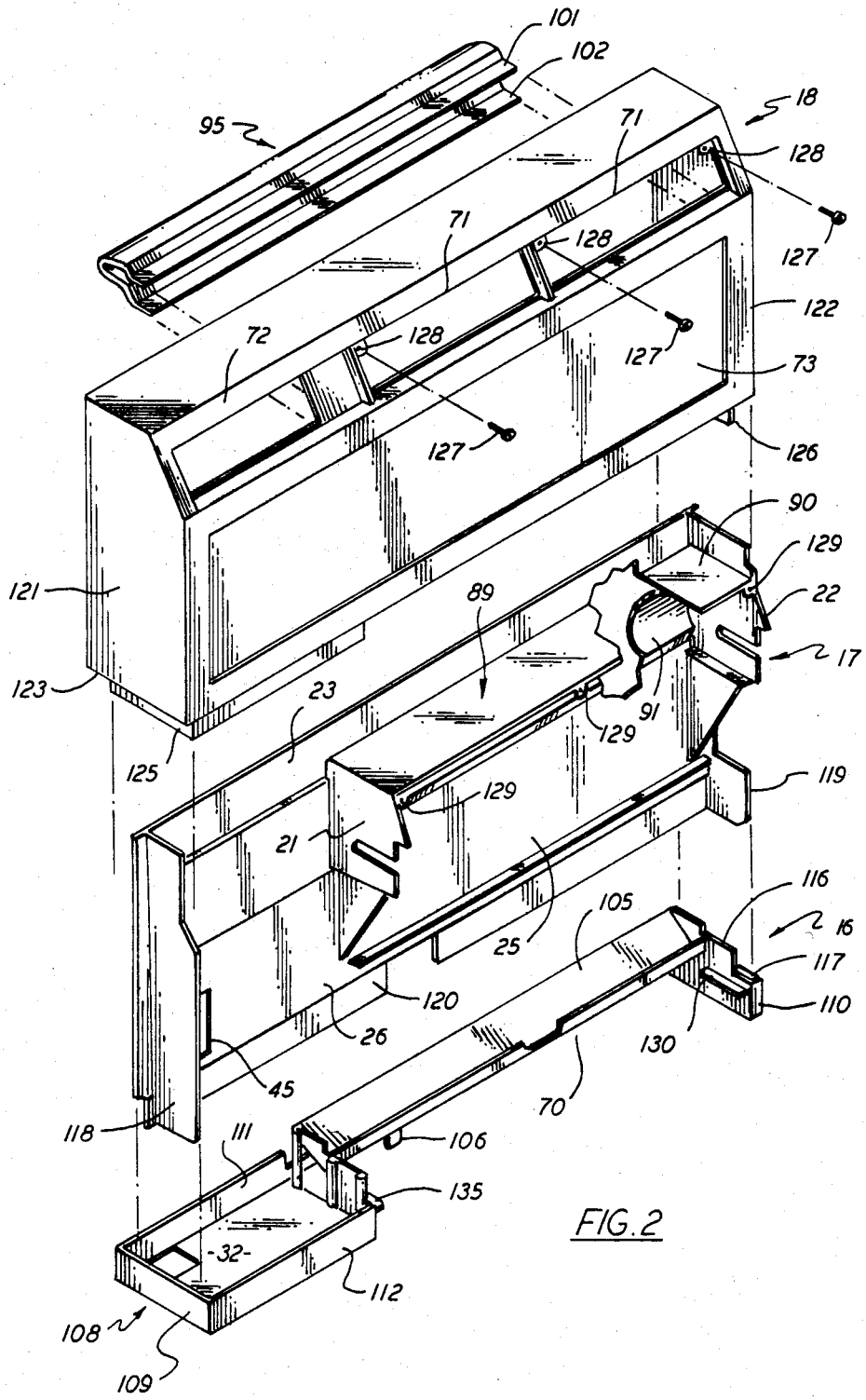
FIG. 2 is an exploded view of the molded indoor cabinet illustrated in FIG. 1.
Figure 4:
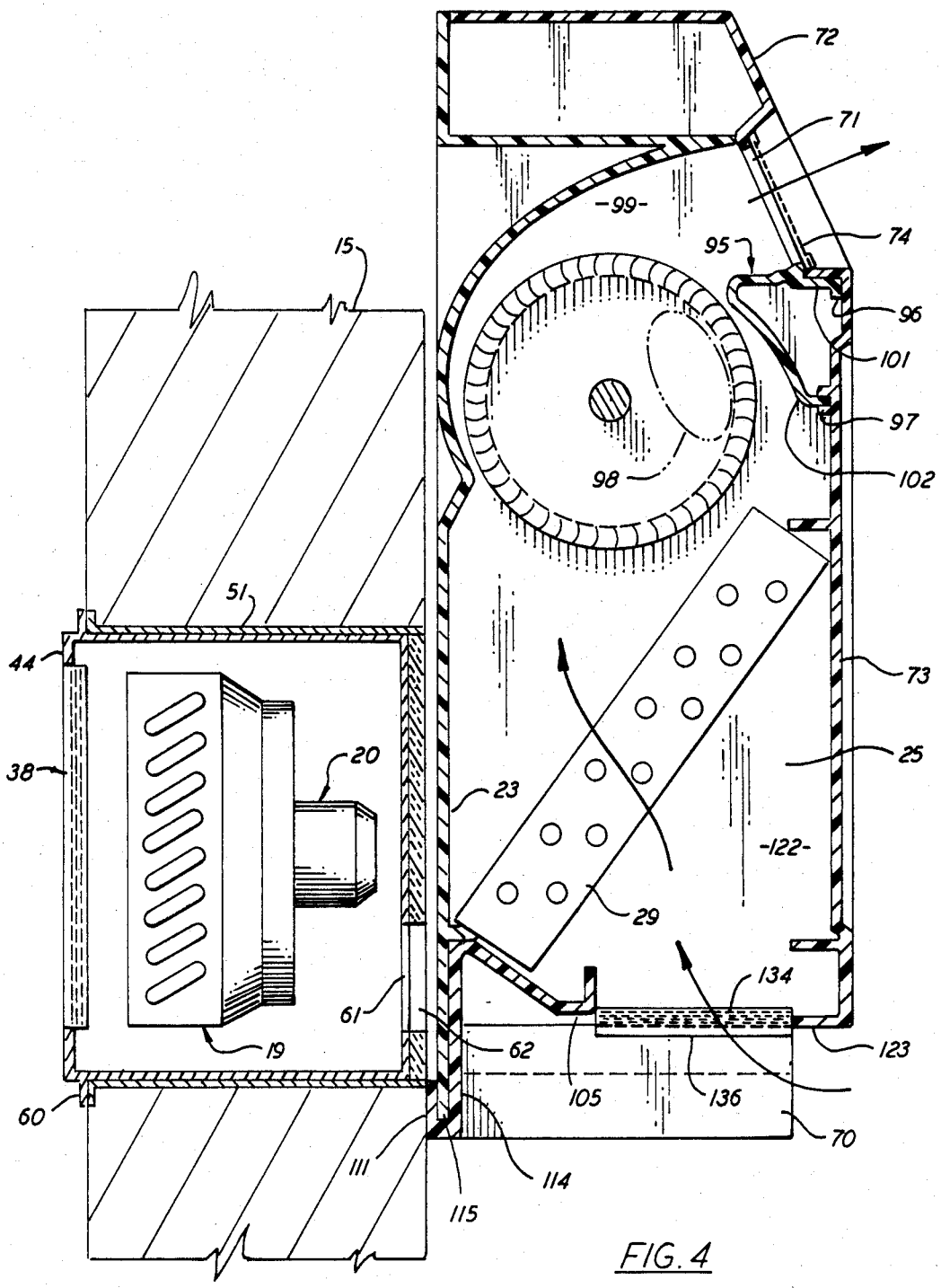
FIG. 4 is an enlarged sectional view taken along line 4—4 in FIG. 1.

Turning now to the drawings, and in particular to FIGS. 1–4, there is shown a package terminal air conditioning unit generally referenced 10 that includes an indoor cabinet 11 and an outdoor cabinet 12 which house the component parts of an air conditioning system for heating and/or cooling a specific region inside a building. The indoor cabinet is formed of three main molded sections that interlock in assembly to furnish a self-standing unit that can be conveniently placed adjacent an outdoor wall of a building 15 as shown in FIG. 4. As illustrated in FIG. 2, the indoor cabinet includes a rectangular open topped base section 16, a back section 17 and a front cover section 18. All sections are molded from a structural sytrene to create a high strength, rustproof enclosure that is highly resistant to scratching or denting. As will become apparent from the disclosure below, the indoor cabinet of the present invention can be adapted to accommodate air conditioning units having different capacities and containing component parts of varying shapes and sizes without changing the basic configuration of the cabinet.

The present invention is embodied in what is sometimes referred to as a "split-package" in which some component parts of the air conditioning system are housed in an outdoor cabinet and the remaining component parts are housed in the indoor cabinet. In many split packages, an outdoor heat exchanger along with the system compressor are mounted on a concrete pad outside the building. As will be explained in greater detail below, the apparatus of the present invention departs from most split systems in that the compressor is removed from the outdoor unit and housed in the indoor cabinet. This considerably lightens the outdoor unit and enables the cabinet to be correspondingly reduced in size.

As best illustrated in FIG. 3, the interior of the indoor cabinet is divided by vertical walls 21 and 22 into two adjacent vertically disposed chambers. The walls 21 and 22 are molded integrally with the back panel 23 of the back section 17 and serve to separate the interior of the cabinet into a recirculating air duct 25 and an equipment compartment 26. A fan coil type indoor heat exchanger 27 is obliquely mounted in the lower part of the air duct 25 by securing the unit to walls 21 and 22 using suitable end mounting brackets 29—29. A cylindrical crossflow fan rotor 28 is also supported between the vertical walls 21 and 22 directly over the heat exchanger. The fan rotor is adapted to pull indoor air into the cabinet and pass the air over the heat exchanger surfaces before discharging the air back into the air conditioned region.

The system compressor 31 is mounted in the equipment compartment adjacent to the air duct. The compressor is affixed to the floor 32 of the base section by means of bolts 33 or any other suitable means. As noted, other components of the air conditioning system are also housed in the equipment compartment. These may include, but are not necessarily limited to, expansion valves 34, electrical components 36, electrical lines 37, air accumulator tanks 39 and refrigeration lines 40 and 41. Ample room is furnished in the equipment compartment so that almost any type of suitable air conditioning or heat pump system can be accommodated within the indoor cabinet.

As best illustrated in FIG. 4, the outdoor cabinet contains a second outdoor heat exchanger 18 and a motor driven blower 20 which are housed in a small rectangular shaped cabinet 37. The outdoor heat exchanger is connected to the other air conditioning components by the heretofore mentioned refrigeration lines 40 and 41. As further illustrated in FIGS. 5 and 6 the two connecting refrigeration lines, along with an electrical cord 43 for servicing the blower motor are shielded within a protective sheath 44 that extends between the two cabinets. The connecting lines and wires pass out of the back of the indoor cabinet through a small opening 45 formed in the back section of the cabinet. The sheath is a relatively small bundle that can be easily passed through wall 15 or any other suitable structure such as a window frame or the like. The back of the cabinet is closed by grill 38.

Figure 5:
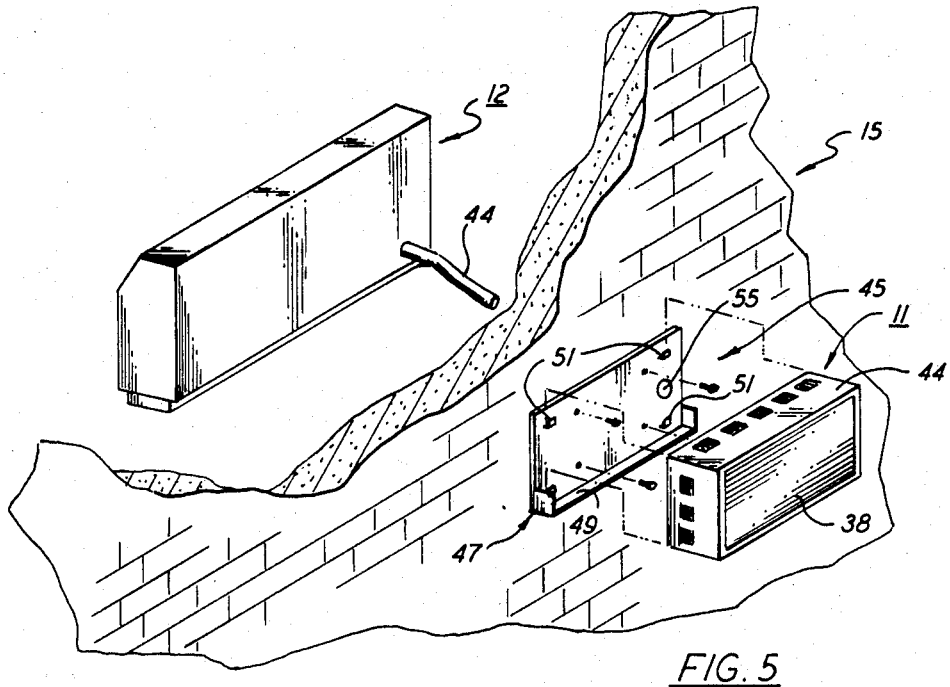
FIG. 5 is a perspective view showing one form of the invention wherein the outdoor cabinet is hung upon an exterior wall bracket.
Figure 8:
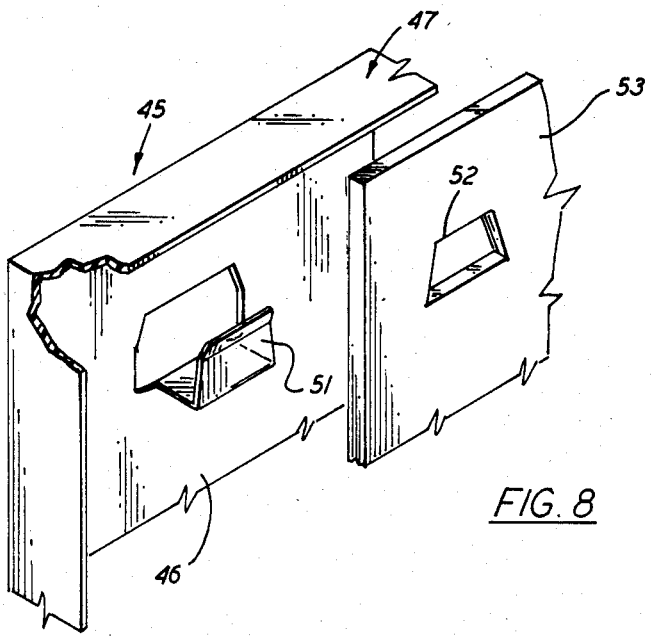
FIG. 8 is an enlarged partial perspective view of the wall bracket shown in FIG. 5.

The outdoor cabinet of the present unit, because it houses a minimum number of components, is relatively lightweight and compact. The outdoor unit can thus be mounted in places not available to heavier and bulkier units. As illustrated in FIG. 5, the outdoor unit 11 can be hung from a wall bracket 45 secured to the outside of wall 15 adjacent to the indoor unit 12. The wall bracket includes a back plate 46 and a peripheral shield 47 (FIG. 8). The lower lip of the shield provides a horizontal flange 49 upon which the cabinet rests in assembly. The wall bracket is attached to the wall by lag bolts 50—50 or any other suitable means. Four hook-shaped hangers 51—51 are formed in the back plate 46. Each hanger is adapted to be received in an opening 52 formed in member 53 mounted in the front of the outdoor cabinet. A hole 55 (FIG. 5) is formed in the wall bracket through which the sheath 44 is passed into the outdoor unit.

Figure 6:
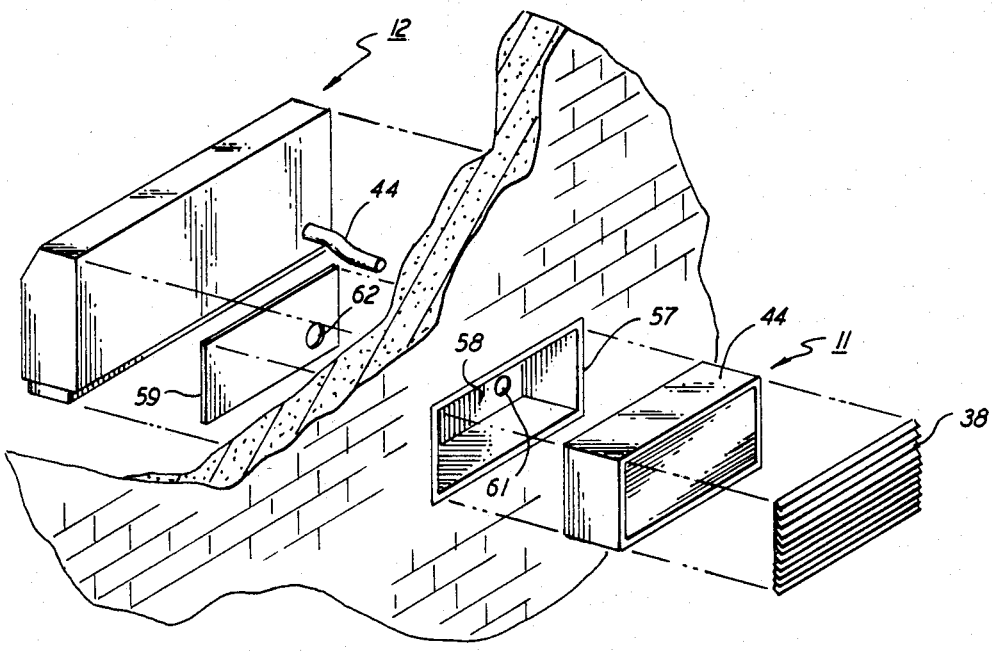
FIG. 6 is a perspective view showing another form of the invention wherein the outdoor cabinet is flush mounted in a wall opening.

Turning now to FIGS. 4 and 6, there is shown another means of mounting the present package unit within the wall structure of a building. In this embodiment of the invention the outdoor cabinet is flushed mounted within an open housing 57 contained within the wall 15. The back wall 58 of the housing is secured by any suitable means to an anchor plate 59 set into the wall. The cabinet is slidably received inside the housing and locked in place by means of a bolting flange 60 (FIG. 4) or any other suitable locking means. Here again, holes 61 and 62 are provided in the housing and the anchor plate, respectively, through which the sheath 44 can pass into the outdoor cabinet. The outdoor cabinet is approximately 10″ deep and therefore can be conveniently accommodated within most standard size walls.

As noted above, the back section 17 of the cabinet contains a pair of spaced apart walls 21 and 22 that are molded as an integral part of this section. The two vertical walls and the front cover section 18 cooperate in assembly to enclose both the air duct 25 and the equipment compartment 26. The air duct serves to connect an air inlet vent 70 formed in the base section 16 with a pair of air outlet vents 71—71 (FIG. 2) formed in the inclined partition 72 that makes up part of the front wall 73 of the cover section. As seen in FIG. 1, removable screens 74—74 are placed over the outlet vents to enhance the aesthetic value of the cabinet and to prevent foreign objects from entering the air passage.

Figure 7:
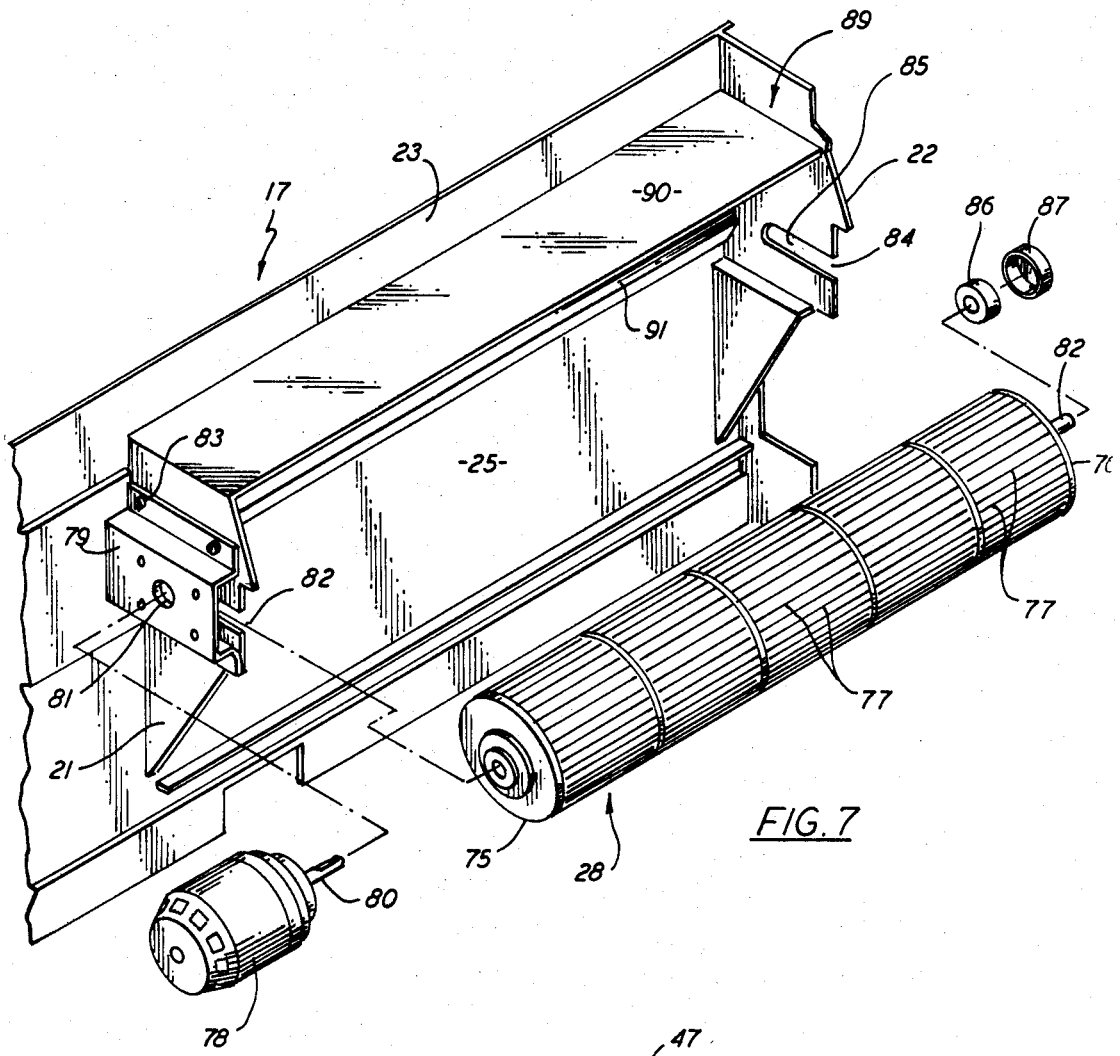
FIG. 7 is a partial view in perspective showing the circulating air duct of the indoor unit opened and the fan unit housed in the duct exploded to better illustrate the manner in which the fan is mounted in the duct.

The noted fan assembly, generally referenced 30 in FIG. 7, includes a high efficiency crossflow fan rotor 28 of cylindrical construction. Crossflow fan rotors of this type are manufactured by Ziehl-Abegg of Kumbelsau, West Germany. The rotor contains a pair of spaced end plates 75 and 76 between which are suspended a series of blades 77—77. Unlike more conventional blades, blades 77—77 are forwardly curved in regard to the direction of rotation of the rotor. The blades are equally spaced about the circumference of the rotor structure between the end plates. The rotor is driven by an electrical motor 78 secured in a U-shaped mounting bracket 79 affixed by screws 83 or any other suitable means to the outside of vertical wall 21. The motor shaft 80 passes through hole 81 formed in the bracket and slotted hole 82 formed in wall 21. The shaft is keyed or otherwise joined to end plate 75 so that the rotor turns with the motor to conduct air through the air duct as indicated by the arrows in FIG. 4.

A stub shaft 82 is secured in the opposite end plate 76 of the rotor structure. The distal end of the stub shaft is adapted to pass through a slotted hole 84 formed in wall 22 and is contained in assembly within an open-ended bearing housing 85 (FIG. 7). A roller bearing 86 is press fitted onto the distal end of the shaft and enclosed by a close fitting end cap 87. The cap, in turn, is snuggly fitted within the housing to hold the fan rotor securely in place. With this simple mounting arrangement, the fan is able to turn at relatively high speeds without producing excessive noise or potentially harmful vibrations.

The top of the air duct is closed by a molded element 89 that includes a horizontally disposed reinforcing panel 90 and a volute shaped fan casing 91 in which the fan rotor is housed. Element 89 is molded integrally with both the rear wall 23 and the two vertical walls 21 and 22 of the back section to provide a strong unitized duct structure. In assembly, the top section and the vertical walls of the duct close against the cover section. The fan casing is specially contoured to quietly and efficiently conduct air moving through the duct.

A V-shaped guide vane 95 formed of a suitable plastic or metal material that is removably supported within a pair of receiving channels 96 and 97 (FIG. 4) molded in the back of the cover section. The guide vane and the fan casing are specifically designed to coact with the fan rotor to conduct air quietly and efficiently through the air duct under stable laminar air flow conditions. The guide vane is positioned adjacent to the fan rotor as illustrated in FIG. 4 to establish a small circularly moving band 98 of turbulent air inside the rotor structure that acts to deflect or redirect the incoming flow of air efficiently into the discharge region 99 of the fan. The geometry of this vane is critical to the proper operation of a crossflow fan. In the present indoor cabinet, the guide vane is removable so that it can be changed to accommodate different rotors. Accordingly, the single cabinet can be quickly and easily adapted to accept various air conditioning systems without having to change the configuration of the molded sections.

To change the guide vane in the indoor cabinet, the opposed legs 101 and 102 of the vane are depressed inwardly towards each other until they are aligned with the channel openings. The legs are then inserted into the channels and released whereupon the legs spring into locking contact against the channel walls.

A trough 105 is molded into the base section of the cabinet immediately below the air duct. The trough is designed to catch condensate that might run off the obliquely positioned indoor heat exchanger 27. A drain 106 (FIG. 2) is mounted in the bottom of the trough which is connected to a drain line (not shown) arranged to carry away any condensate that is collected in the trough.

The base section of the cabinet contains a raised railing generally referenced 108 that surrounds the periphery of the floor panel 32. The railing includes two side rails 109 and 110, a back rail 111 and a front rail 112. The back rail coacts with the vertical back wall 114 of the trough to form an elongated slot 115 (FIG. 4) at the back of the base section. The end wall 116 of the trough further coacts with rail 110 to provide a side opening 117 in this base section. The air inlet vent passes through the front of the railing and is located immediately beneath the air duct 25 adjacent to the trough.

The back section 17 of the cabinet is equipped with an elongated left side tab 118 and a second opposing right side tab 119. The lower portion of elongated tab 118 is slidably received inside rail 109 while tab 119 is similarly received in side opening 117. The two tabs are joined by an elongated apron 120 formed along the bottom edge of rear wall 23. The apron is adapted to slide snuggly into the noted rear slot 115 and thus support the molded back section of the cabinet in an upright position within the base section.

With the back section contained within the base section, the cover section is interlocked with the two previously assembled sections to close the cabinet. The cover section is retangular in form but slightly larger all around than the base section so that the front wall 73 and the two side walls, 121 and 122 of the cover section overhang the base slightly. A horizontal ledge 123 is inwardly disposed from the front wall and two side walls of the cover section which is seated upon the railing 108 of the base. As shown in FIG. 2 a pair of vertically extended flanges depend from the ledge and include an L-shaped flange 125 and a straight flange 126. The L-shaped flange is slidably received inside rails 109 and 112 of the base section with the tab 118 of back section 17 being situated inside the flange. The straight flange 126 is similarly received within the side opening 117 with the tab 119 of back section 17 again being positioned inside the flange.

Screws 127—127 are used to secure cover section 18 to back panel section 17. As illustrated in FIG. 2, the screws are mounted in molded bases 128—128 located inside the air outlet vents 71—71 and are threaded into holes 129—129 formed in the top element of the air duct. In assembly, the screws are covered by the protective screens 74—74 used to cover the outlet vents. As can be seen, by tightening the screws, the walls of the air duct are drawn securely against the front wall of the cover section to provide a tightly closed chamber connecting the air inlet vent and the two air outlet vents. The inlet vent 70 to the air duct is covered by a removable air filter 134 which is suspended between a pair of brackets 135 and 136 mounted upon the base section inside the inlet vent opening 70 (FIG. 2).

The horizontal top wall 137 of the cover section is joined to the inclined partition 72 of the front wall and provides a shelf upon which decorative items may be placed. An access door 138 is also hingedly mounted in the inclined partition of the front wall, behind which a control panel (not shown) of the air conditioner may be conveniently mounted.

As should be evident from the disclosure above, all the equipment contained within the present cabinet is mounted upon either the base section or the back panel section. By removing the cover section, unobstructed access is provided to both the air handling equipment and the air conditioning equipment stored within the cabinet. It should be further noted that the cabinet's all molded construction not only provides for a rustproof unit but also permits the air passage through the cabinet to be contoured to enhance the flow of air moving therethrough. By use of interchangeable guide vanes in the air passage, the cabinet can be easily adapted to accommodate almost any type of air conditioning system without loss of air handling efficiency. The all molded construction of the cabinet further provides for a high strength aesthetically pleasing unit that is both dent and scratch resistant.

It should be further noted that the package terminal unit herein disclosed can be conveniently mounted in new or existing structures without having to create large openings in the wall of the structure. As illustrated in FIG. 5, the outdoor unit of the system is relatively light and can thus be hung or otherwise suspended from an outside wall of the structure using a simple wall bracket.

While this invention has been described in detail with reference to particular embodiments, it should be understood that many modifications and variations would be apparent to those of skill in the art without departure from the scope and spirit of the invention, as defined in the appended claims.

What is claimed is:

1. In a package terminal air conditioning unit that is formed of an interior unit disposed within a building, a separate exterior unit disposed outside the building, and connecting duct means connecting the interior unit to the exterior unit, in which the interior unit comprises a cabinet, an indoor heat exchanger coil, and a cylindrical fan which includes a cylindrical fan rotor, means mounting the rotor in the cabinet, and a volute shaped member; said exterior unit comprises an outside heat exchanger coil and an outside cabinet separated from said indoor cabinet and housing said outdoor heat exchanger; and said connecting duct means comprises a pair of refrigerant lines passing between the two cabinets for connecting the two heat exchanger coils, a compressor, and an expansion valve to complete an air conditioning circuit; the improvement wherein said compressor is contained in the indoor cabinet of the interior unit so that the exterior unit is kept as small and light as possible, and has a relatively small power requirement as compared with the interior unit; said indoor cabinet is molded of a synthetic resin and is formed of a base section, a back section, and a removable front cover section that interlock to form an equipment compartment that houses said compressor and an adjacent air duct that connects an inlet vent and an outlet vent with the indoor heat exchanger coil situated therebetween; both of which compartments are opened by removal of only the front cover section;

said back section having an integral molded volute-shaped casing that forms a part of the air duct for housing the cylindrical fan rotor and integral support means for mounting the indoor heat exchanger coil in said air duct;

said base section including means for mounting the compressor in said equipment compartment and;

said front cover section including a guide vane removably mounted therein that is positioned in said air duct adjacent the fan for directing the air therethrough.

2. The air conditioning unit of claim 1 wherein the two cabinets are separated by a wall and further includes a wall bracket mounted on the outside of said wall having hanger means for suspending said outdoor cabinet from said wall bracket.

3. The air conditioning unit of claim 2 wherein said wall bracket includes a vertical back plate having clip means for removably engaging the outdoor cabinet.

4. The air conditioning unit of claim 3 that further includes a horizontally disposed lower flange secured to the back plate upon which the outdoor cabinet rests.

5. The air conditioning unit of claim 1 wherein said back section contains a pair of spaced vertical walls molded integrally therewith and which cooperate with the casing to define the air duct and said cylindrical fan and said indoor heat exchanger being suspended between said walls.

6. The air conditioning unit of claim 5 that further includes a motor means for rotating said fan which is mounted on one of said walls within the equipment compartment.

7. The air conditioning unit of claim 5 wherein said base section further includes a trough means molded integrally therewith that is positioned inside the air duct beneath the indoor heat exchanger and a drain means connected to said trough for carrying condensate collected in each trough out of the indoor cabinet.

8. The air conditioning unit of claim 1 wherein the indoor cabinet is positioned adjacent to an outdoor wall of a building and the outdoor cabinet is mounted within the wall with the outer face of the cabinet being flush with the outer surface of the wall.

9. The air conditioning unit of claim 1 wherein the cylindrical fan includes a crossflow rotor having blades that are forwardly curved in the direction of rotation.

10. The air conditioning unit of claim 1 that further includes a blower mounted in the outdoor cabinet for moving ambient air over the outdoor heat exchanger.

11. The air conditioning unit of claim 10 wherein said conduit means comprises said pair of refrigerant lines, an electric power cable for powering the blower of the exterior unit, and a conduit for carrying condensed moisture from the interior unit to the exterior unit.

* * * * *